United States Patent [19]

Hasegawa et al.

[11] 4,412,875

[45] Nov. 1, 1983

[54] NITRAMINE COMPOSITE PROPELLANT COMPOSTION

[75] Inventors: Kunio Hasegawa, Aichi; Michinori Takizuka, Handa, both of Japan

[73] Assignee: Nippon Oil and Fats Co., Ltd., Tokyo, Japan

[21] Appl. No.: 308,770

[22] Filed: Oct. 5, 1981

[30] Foreign Application Priority Data

Oct. 7, 1980 [JP] Japan ..... 55-139348

[51] Int. Cl.[3] ..... C06B 45/10

[52] U.S. Cl. ..... 149/19.9; 149/92

[58] Field of Search ..... 149/19.9, 92

[56] References Cited

U.S. PATENT DOCUMENTS

| | | | |
|---|---|---|---|
| 3,834,957 | 9/1974 | McDevitt et al. | 149/19.9 |
| 4,090,893 | 5/1978 | Cucksee et al. | 149/19.9 |
| 4,092,188 | 5/1978 | Lovelace | 149/92 |
| 4,099,376 | 7/1978 | Japs | 149/19.9 |
| 4,156,700 | 5/1979 | Tremblay et al. | 149/19.9 |

*Primary Examiner*—Edward A. Miller

*Attorney, Agent, or Firm*—Flynn, Thiel, Boutell & Tanis

[57] ABSTRACT

Addition of a specified alkanol amine and a polybutadiene having terminal maleic anhydride groups to a conventional nitramine composite propellant which contains a nitramine oxidizer in a high content improves the resulting uncured propellant slurry in fluidity and the cured propellants are excellent in mechanical and burning properties.

6 Claims, No Drawings

NITRAMINE COMPOSITE PROPELLANT COMPOSTION

BACKGROUND OF THE INVENTION

Field of the Invention

This invention relates to a nitramine composite propellant composition which is improved in its casting characteristics during the production of propellants and in its mechanical properties as a propellant.

Conventional composite propellants comprise as main components, solid oxidizers and binders which also act as fuels (hereinafter referred to as binder), and they contain the oxidizers in high ratios.

Recently, a composition of composite propellant containing a larger amount of the oxidizer as compared with conventional ones is desired because of a demand for a higher performance of the propellant.

However, in conventional composite propellants, an increased amount of the oxidizer causes an increase of the viscosity of the slurry which is a mixture of the binder and the oxidizer, with the result being that coating becomes impossible in producing the propellant and in an extreme case, it is not possible to effect the mixing of the binder and the oxidizer.

Although the propellant can be prepared, the adhesive characteristics of the binder and the oxidizing agent after the curing are spoiled and the characteristics such as mechanical strength and elongation are degraded with the result being that a dewetting of the binder occurs on the surface of the oxidizer under severe environmental conditions thereby to cause cracks in the propellant, which may result in a possibility of extraordinary combustion on ignition or burning.

Various class of additives have been proposed in order to improve such drawbacks.

It is known, for example, that the mechanical properties of the propellants are improved by using as the additives imines such as tris(2-methylaziridinyl)phosphine oxide (hereinafter referred to as MAPO) or alkanol amines such as diethanol amine and triethanol amine, which act as surface bonding agents, when the binders are of the polybutadiene series and the oxidizer is ammonium perchlorate (hereinafter referred to as AP) or the like.

The indication that the characteristics of propellant are improved means herein that the physical strengths of the propellant such as the tensile strength are high and the elongation is large and that the ratio of the elongation of the propellant at the maximum tensile strength to the elongation at the fracture point has a value near to one. The relation between the elongation at the maximum tensile strength and the elongation at the fracture point is not explained herein in detail but the values of the ratio which are near to one mean that the adhesion of the solid components and the binder layers are firm and that their relation approaches that of an ideal state.

In addition, it is known that the above stated imines also improve the fluidity characteristics because they act as pot life extenders.

On the other hand, additives which are effective to provide easy casting during production of the propellants and are effective to improve the propellant characteristics have not been found in the case of nitramine composite propellants in which the binders are of the polybutadiene series and the oxidizers are nitramines which propellants recently have attracted public attention as smokeless propellants of high specific thrust.

The mechanical properties of nitramine composite propellants are rather degraded by the addition of imines therein, which latter are effective when the oxidizer is AP, and the addition of alkanol amines therein extremely deteriorates the fluidity with the result being that it becomes very difficult to effect casting, although it improves the mechanical properties of the nitramine composite propellant.

SUMMARY OF THE INVENTION

A main object of this invention is to provide a nitramine series composite propellant which is easily castable during production of the nitramine composite propellant.

Another object of this invention is to provide a nitramine composite propellant which is excellent in mechanical properties such as elastic modulus, maximum tensile strength and elongation.

A further object of this invention is to provide a nitramine composite propellant which is excellent in combustion performance.

This invention is based on the findings that the addition of a specified alkanol amine and a polybutadiene having terminal maleic anhydride groups into a conventional composition of a nitramine composite propellant which contains a high content of nitramine oxidizer, improves the fluidity of the resulting uncured propellant slurry and that the cured propellants are excellent in mechanical and burning properties.

The nitramine composite propellant of this invention is prepared by incorporating, as binder components, 100 parts by weight of a polybutadiene and 0.5 to 10 parts by weight of a polybutadiene having terminal maleic anhydride groups and 0.5 to 10 parts by weight of alkanol amines in a propellant composition which has a binder of polybutadiene and a nitramine oxidizer as main components.

The binder of polybutadiene which is used in this invention contains a polybutadiene which is a main component of the binder, a polybutadiene having terminal maleic anhydride groups and alkanol amines and further contains a curing agent which is usually used in a binder of polybutadiene.

In addition, the binder may contain a plasticizer, an anti-oxidant, an interface bonding agent and the like, if desired. Polybutadienes include a polybutadiene having terminal hydroxyl groups (hereinafter referred to as HTPB), a polybutadiene having terminal carboxyl groups (hereinafter referred to as CTPB) and the like.

As the curing agent, isocyanates such as an isophorone diisocyanate (hereinafter referred to as IPDI) is used when the polybutadiene is HTPB, and imines such as MAPO and/or an epoxide curing agent are used when the polybutadiene is CTPB.

The plasticizer and the anti-oxidant include conventional ones. Imines such as MAPO are effective as the interface bonding agent when the polybutadiene is HTPB and the oxidizer is AP.

The nitramine oxidizers of this invention include conventional ones such as cyclotrimethylene trinitramine (hereinafter referred to as RDX), cyclotetramethylene tetranitramine (hereinafter referred to as HMX) and the like.

These nitramine oxidizers are used individually or in a mixture of more than one of them.

The amounts of the polybutadiene binder and the nitramine oxidizer are from 75 to 90 % by weight for the nitramine oxidizer and 25 to 10% by weight for the polybutadiene binder, based on the total weight of the polybutadiene binder and the nitramine oxidizer in view of the oxygen balance and the combustion performance.

The polybutadiene having terminal maleic anhydride groups used in this invention is preferably a compound shown in the following formula $$MA\text{-}(C_4H_6)_n\text{-}MA$$

wherein n is an integer of 20 to 65 and MA represents a maleic anhydride group, in view of improving the fluidity of the slurry.

An "n" value of less than 20 results in a reduced compatibility with the binder and an "n" value of more than 65 causes an increase of the viscosity of the binder and the fluidity is adversely affected.

The addition amount of this compound is preferably within the range of 0.5 to 10 parts by weight based on 100 parts by weight of the polybutadiene which is the main component of the polybutadiene binder. An amount less than 0.5 part by weight gives little effect in improving the fluidity of the slurry, whereas an amount of more than 10 parts by weight reduces the combustion performance of the propellant. Therefore, these amounts are not preferable.

As the specified alkanol amines, there can be used compounds having the formula $C_nH_{2n+1}N(C_2H_4OH)$ wherein when n is 0, m is 3 and when n is from 1 to 4, m is 2, for example, triethanol amine (TEA), butylimino diethanol (BIDE), methylimino diethanol (MIDE), ethylimino diethanol (EIDE), propylimino diethanol (PIDE) and the like are preferable in view of improving the mechanical properties of the propellant. These alkanol amines are used individually or in a mixture of more than one of them.

The addition amount of the alkanol amines is preferably in the range of 0.5 to 10 parts by weight based on 100 parts by weight of the polybutadiene which is the main component of the polybutadiene binder. An amount of less than 0.5 part by weight gives little effect in improving the mechanical properties of the propellant, but that more than 10 parts by weight is not advantageous because it reduces the combustion performance and the improvement in the mechanical properties does not much differ from the results obtained using 10 parts by weight.

In the nitramine composite propellant composition of this invention, in addition to the above stated components, powder of a metal such as aluminum and the like or a burning catalyst for adjusting the burning properties can be added. A part of the nitramine oxidizer may be replaced with AP.

The nitramine composite propellant composition of this invention, which comprises the above stated components, can be prepared as mentioned hereinbelow.

The components of the polybutadiene binder are first premixed and agitated. Then a curing agent is added to them with subsequent agitation followed by the addition of a nitramine oxidizer or the nitramine oxidizer and followed by the addition of the curing agent.

Thereafter the resultant mixture is mixed in a mixer at an elevated temperature.

After the mixing, the slurry, which is the product of the mixing, is cast under reduced pressure and is cured at an elevated temperature to obtain the propellant.

The nitramine propellant composition of this invention is easily castable when the propellant is produced and further, the resulting propellant is excellent in mechanical properties.

This invention is illustrated by the following Examples.

EXAMPLE 1

Mixed compositions of this Example shown in Table 1 were prepared as stated hereinbelow.

A hydroxyl terminated polybutadiene (HTPB, polybd R-45 M, trademark, produced by Alco Co.) in an amount of 800 g were incorporated with 80 g of a plasticizer, dioctyl adipate (DOA) and they were well agitated. Then 16 g of triethanol amine (TEA) and 16 g of a polybutadiene having terminal maleic anhydride groups whose polybutadiene chain had an average molecular weight of 1600 (n=30, M-PO-5, trademark, produced by Nippon Zeon Co., Ltd.) were added into them and the obtained mixture was well agitated.

Subsequently, 88 g of a curing agent, isophorone diisocyanate (IPDI, produced by VEBA Chemie Co.) were added into the mixture and the resultant mixture were agitated. Into the resultant mixture, 4000 g of RDX were added and they were mixed in a vertical mixer adjusted at 60° C. for 60 minutes. Immediately after the completion of the mixing the viscosity of the slurry was measured by using an EHD-type rotational viscometer. Then, the slurry was cast in a small combustion motor having a diameter of 80 mm and a length of 140 mm under reduced pressure. Separately, the slurry was cast in another vessel for preparing a sample for testing its mechanical properties under the same conditions.

They were respectively cured at 60° C. for 7 days to obtain propellants. One part of the resultant propellant was used for the combustion test as a small size combustion motor. Sample specimens were prepared from the other part of the propellant according to JANNAF and they were employed for the tensile test. The thus obtained values of slurry viscosity and mechanical properties and the combustion performance of the propellants are shown in Table 1, in which the parts are expressed by weight base.

EXAMPLE 2

A propellant composition was prepared in a similar manner as in Example 1 except for using butylimino diethanol (BIDE) instead of triethanol amine.

A propellant composition having the mixing composition of Example 2 as shown in Table 1 was obtained. The measurement of the slurry viscosity and the combustion test and the tensile test of the propellants were carried out in the same way as in Example 1. The respective results are shown in Table 1.

EXAMPLE 3

A propellant composition was prepared according to the same procedures as those described in Example 1 except for using methylimino diethanol (MIDE) and HMX instead of triethanol amine and RDX, respectively. A propellant composition having the mixing composition of Example 3 as shown in Table 1 was obtained.

The measurement of the slurry viscosity and the combustion test and the tensile test of the propellants were carried out in the same way as in Example 1. The respective results are shown in Table 1.

EXAMPLE 4

A propellant composition was prepared in a similar manner as in Example 1 except for using a higher molecular weight of the polybutadiene having terminal maleic anhydride groups (the average molecular weight of the polybutadiene chains being 3,000 (n=56), trade mark: M-PO-15, produced by Nippon Zeon Co., Ltd.) instead of the polybutadiene having terminal maleic anhydride groups of Example 1. A propellant composition having the mixing composition of Example 4 as shown in Table 1 was obtained.

The measurement of the slurry viscosity and the combustion test and the tensile test of the propellants were carried out in the same way as in Example 1. The respective results are shown in Table 1.

EXAMPLES 5 AND 6

Propellant compositions were respectively prepared in a similar manner as in Example 1 except for changing the amounts of triethanolamine and the polybutadiene having terminal maleic anhydride groups.

Propellant compositions having the mixing compositions of Examples 5 and 6 as shown in Table 1 were respectively obtained.

The measurements of the slurry viscosities and the combustion tests and the tensile tests of the propellants were carried out in the same way as in Example 1. The respective results are shown in Table 1.

EXAMPLE 7

A propellant composition was prepared according to the same procedures as those in Example 1 except for using a carboxyl terminated polybutadiene (CTPB, trade mark: HC-434, produced by Thiokol Corporation) instead of the hydroxyl terminated polybutadiene and except for using MAPO (produced by Arsynco Corporation) and an epoxide series curing agent (trade mark: ERLA-0510, produced by Union Carbide Corporation) instead of the IPDI used as the curing agent.

A propellant composition having the mixing composition of Example 7 as shown in Table 1 was obtained.

The measurement of the slurry viscosity and the combustion test and the tensile test of the propellants were carried out in the same way as in Example 1. The respective results are shown in Table 1.

COMPARATIVE TEST 1

A propellant composition was prepared in a similar manner as in Example 1 except for excluding the alkanol amine and the polybutadiene having terminal maleic anhydride groups.

A propellant composition having the mixing composition of comparative Test 1 as shown in Table 1 was obtained.

The measurements of the slurry viscosity and the combustion test and the tensile test of the propellants were carried out in the same way as in Example 1. The respective results are shown in Table 1.

COMPARATIVE TESTS 2 AND 3

Propellant compositions were respectively prepared in a similar manner as in Example 1 except for excluding the polybutadiene having terminal maleic anhydride groups or triethanol amine.

Propellant compositions having the mixing compositions of Comparative Tests 2 and 3 as shown in Table 1 were respectively obtained.

The measurements of the slurry viscosities and the combustion test and the tensile test of the propellants were carried out in the same way as in Example 1. However, the combustion test was not conducted in Comparative Test 1, because the slurry showed such a high viscosity value that it was impossible to cast it in the small size combustion motor. The respective results are shown in Table 1.

COMPARATIVE EXAMPLE 4

A propellant composition was prepared in a similar manner as in Example 7 except for excluding the alkanol amine and the polybutadiene haveing terminal maleic anhydride groups. The propellant composition having the mixing composition of Comparative Test 4 as shown in Table 1 was obtained.

The measurement of the slurry viscosity and the combustion test and the tensile test were carried out in the same way as in Example 1.

The respective results are shown in Table 1.

As seen from the test results of the Examples and Comparative Examples, it can be recognized that the propellants from the propellant compositions of this invention (Examples 1 to 7) which contained the alkanol amines and the polybutadiene having terminal maleic anhydride groups were about 2 times as large in the value of elongation as the propellants of Comparative Tests 1 and 4 which did not contain either alkanol amines nor polybutadiene having terminal maleic anhydride groups and that the maximum tensile strength was large and that the values of ratio of the elongation at the fracture point to the elongation were near to one and accordingly the propellants of the present invention were of especially good physical characteristics.

TABLE 1

| | | Examples | | | | | | | Comparative Examples | | | |
|---|---|---|---|---|---|---|---|---|---|---|---|---|
| | | 1 | 2 | 3 | 4 | 5 | 6 | 7 | 1 | 2 | 3 | 4 |
| Binder composition | HTPB | 100 | 100 | 100 | 100 | 100 | 100 | — | 100 | 100 | 100 | — |
| | CTPB | — | — | — | — | — | — | 100 | — | — | — | 100 |
| | TEA | 2 | — | — | 2 | 0.5 | 9 | 2 | — | 2 | — | — |
| | BIDE | — | 2 | — | — | — | — | — | — | — | — | — |
| | MIDE | — | — | 2 | — | — | — | — | — | — | — | — |
| | Polybutadiene having terminal maleic anhydride groups (n = 30) | 2 | 2 | 2 | — | 0.5 | 9 | 2 | — | — | 2 | — |
| | Polybutadiene having terminal maleic anhydride groups | — | — | — | 2 | — | — | — | — | — | — | — |

TABLE 1-continued

| | | Examples | | | | | | | Comparative Examples | | | |
|---|---|---|---|---|---|---|---|---|---|---|---|---|
| | | 1 | 2 | 3 | 4 | 5 | 6 | 7 | 1 | 2 | 3 | 4 |
| | (n = 56) | | | | | | | | | | | |
| | D O A | 10 | 10 | 10 | 10 | 10 | 10 | 10 | 10 | 10 | 10 | 10 |
| | I P D I | 11 | 11 | 12 | 11 | 8.4 | 25 | — | 7.4 | 11 | 7.4 | — |
| | M A P O | — | — | — | — | — | — | 3 | — | — | — | 3 |
| | Epoxide curing agent ERLA - 0510 | — | — | — | — | — | — | 1 | — | — | — | 1 |
| Propellant Composition | Binder | 20 | 15 | 20 | 20 | 20 | 20 | 20 | 20 | 20 | 20 | 20 |
| | Oxidizer R D X | 80 | 85 | — | 80 | 80 | 80 | 80 | 80 | 80 | 80 | 80 |
| | Oxidizer H M X | — | — | 80 | — | — | — | — | — | — | — | — |
| | Slurry-viscosity at 60° C. (K P) | 3.7 | 6.5 | 3.4 | 4.1 | 3.8 | 4.5 | 8.0 | 4.4 | 27.4 | 2.5 | 110 |
| Mechanical* properties (20° C.) | Elastic Modulus (kg/cm$^2$) | 21 | 48 | 20 | 21 | 19 | 34 | 25 | 27 | 23 | 23 | 30 |
| | Maximum tensile strength (kg/cm$^2$) | 9.8 | 10.3 | 8.7 | 9.3 | 8.3 | 9.6 | 8.1 | 5.4 | 8.2 | 4.6 | 6.5 |
| | *[1]Elongation (%) | 70 | 48 | 75 | 69 | 72 | 64 | 59 | 31 | 82 | 33 | 27 |
| | Elongation at the fracture point/elongation at the maximum tensile strength | 1.1 | 1.2 | 1.1 | 1.0 | 1.1 | 1.2 | 1.0 | 1.6 | 1.1 | 1.6 | 1.8 |
| Combustion Performance | Specific thrust (Sec) (P = 80 kg/cm$^2$) | 211 | 217 | 211 | 211 | 212 | 210 | 209 | 211 | — | 212 | 209 |
| | Burning Rate (mn/Sec) (P = 80 kg/cm$^2$) | 4.2 | 4.7 | 3.2 | 4.1 | 4.0 | 4.3 | 3.6 | 4.1 | — | 4.0 | 3.6 |

*Strain rate is 50 mm/min
*[1]Elongation at the maximum tensile strength

Furthermore, while the propellant composition (Comparative Test 2) which did not contain the polybutadiene having terminal maleic anhydride groups had a high slurry viscosity with the result being that the propellant composition could not be cast in the small size combustion motor, the propellant compositions (Examples 1 to 7) of this invention showed no such phenomenon.

Moreover, it was observed that the propellant of Comparative Test 3 which did not contain alkanol amine was low in viscosity, but it was about one-half as large in the maximum tensile strength and the elongation as the propellant of this invention, and that in consequence the propellant of comparative test 3 involves problems in mechanical properties.

The embodiments of the invention in which an exclusive property or privilege is claimed are defined as follows:

1. A nitramine composite propellant containing a polybutadiene binder and a nitramine oxidizer as the main constituent thereof, wherein said polybutadiene binder comprises 100 parts by weight of a carboxyl-terminated polybutadiene or a hydroxyl-terminated polybutadiene, from 0.5 to 10 parts by weight of a polybutadiene having terminal maleic anhydride groups and from 0.5 to 10 parts by weight of an alkanolamine or a mixture of two or more alkanolamines.

2. A nitramine composite propellant as claimed in claim 1 wherein said polybutadiene having terminal maleic anhydride groups has the formula $$MA\text{-}(C_4H_6)_n\text{-}MA,$$

wherein n is an integer of from 20 to 65 and MA is the maleic anhydride group.

3. A nitramine composite propellant as claimed in claim 1 wherein said alkanolamine has the formula $C_nH_{2n+1}N(C_nH_{2n}OH)_m$, wherein when n is 0, m is 3 and when n is 1 to 4, m is 2.

4. A nitramine composite propellant as claimed in claim 2 wherein said alkanolamine has the formula $C_nH_{2n+1}N(C_nH_{2n}OH)_m$, wherein when n is 0, m is 3 and when n is 1 to 4, m is 2.

5. A nitramine composite propellant as claimed in claim 1 in which said alkanolamine is selected from the group consisting of triethanolamine, butyliminodiethanol, methyliminodiethanol, propyliminodiethanol and propyliminodiethanol.

6. A nitramine composite propellant as claimed in claim 1 in which the weight ratio of said nitramine oxidizer to said polybutadiene binder is from (75/25) to (90/10).

* * * * *